United States Patent [19]

Nicholas

[11] Patent Number: 4,516,776

[45] Date of Patent: May 14, 1985

[54] GAME AND KEY CHAIN DEVICE

[76] Inventor: Harry J. Nicholas, 44-4 Candlewood Lake Rd., New Milford, Conn. 06776

[21] Appl. No.: 521,038

[22] Filed: Aug. 8, 1983

[51] Int. Cl.[3] ..... A63F 9/04

[52] U.S. Cl. ..... 273/146; 273/148 R; 273/DIG. 24; 70/459; 63/23

[58] Field of Search ..... 273/146, 147, 148 R, 273/274, 287, DIG. 24, 161, 309; 63/23, 21; D3/62; 70/456 R–460

[56] References Cited

U.S. PATENT DOCUMENTS

| | | | |
|---|---|---|---|
| 1,257,779 | 2/1918 | Anderson | 273/146 |
| 1,279,583 | 9/1918 | Peterson | 273/146 |
| 1,363,567 | 12/1920 | Cobb | 273/146 X |
| 2,306,939 | 12/1942 | Ferris | 273/DIG. 24 UX |
| 2,606,030 | 8/1952 | Tjomsland | 273/DIG. 24 UX |
| 3,011,789 | 12/1961 | Eliassen | 273/148 R X |
| 3,603,593 | 9/1971 | Chew | 273/161 |
| 3,709,495 | 1/1973 | Krombein | 273/DIG. 24 UX |

OTHER PUBLICATIONS

Wham-O Mfg. Co. Circular, ©1969, Moonlighter Frisbee.

Johnson Smith & Co. Catalog p. 84, 1947, Dice Key Chain.

Culin, Stewart; Chess and Playing Cards, 11-1928, pp. 826–832.

*Primary Examiner*—Paul E. Shapiro

*Attorney, Agent, or Firm*—Lawrence Hager

[57] ABSTRACT

A dice like device having a plurality of differently configured sides or surface characteristics each of which enable a corresponding distinctive resting position or placement on a table or other appropriate selected game surface. These surface characteristics are configured such that not all of the sides or ends of the dice device have the same probability of occurrence, i.e., facing upward, with the dice device being tossed onto a surface such as a flat game board. Each distinctive surface and/or rest position has associative significance with one or more features or symbolic meanings according to preferred game(s) rules. The dice device has attachment means provided to enable a key chain or the like to be detachably affixed thereto to facilitate mutual carrying about, easy location and identification and ornamentation of the attached key(s), and to provide a means of convenient portable entertainment.

9 Claims, 5 Drawing Figures

GAME AND KEY CHAIN DEVICE

FIELD OF INVENTION

This invention relates to a game and/or key chain device and, more particularly, to a combination dice device and key chain retaining ornament.

BACKGROUND OF THE INVENTION

Key chains and dice devices have each been known for many years.

Typically, the dice device comprises a cube shaped member having six sides each having indicia, for example, a dimpled colored dot or dots representative of the number one through six and corresponding to a dice side. Each side of the cube like dice has the same probability of occurring facing upwardly.

Various types of key chain ornaments such as a rabbit's foot have been used to adorn one end of a key chain.

In contrast to the prior art, the present invention provides a game and/or entertainment device and/or dice like key chain retainer ornament. The dice like device has a plurality of surfaces each with a different configuration corresponding to a game meaning and having symbolic interrelationship. The dice device may be utilized in cooperation with a board game in accordance with prescribed instructions or used impromptu on any suitable surface generally following the prescribed game(s) format or instructions. The dice like device has attachment means adapted for being affixed to one end of a key chain and to enable easy detachment therefrom to enable separate entertainment use of the dice like device. The present invention provides a device having a simple, robust and relatively inexpensive structure which combines the capabilities and advantages of both a game/toy and a conversational utilitarian device, enables manipulation, is easy to use and involves a minimum of associated parts.

SUMMARY OF THE INVENTION

Generally speaking, in accordance with the invention, a game or entertainment and key chain device is provided which includes a dice like member having a plurality of differently shaped surfaces two or more of which is capable, with a different chance probability, of being face-up with each toss of the dice member. The dice member is adapted for being detachably affixed to a chain having a key ring means affixed to its opposite end to enable keys to be mounted thereon. One or more of the noticeably different surfaces is assigned a game significance and/or symbolic meaning to provide an entertainment vehicle and/or conversation and/or curiosity item.

Accordingly, it is an object of this invention to provide a new game device.

Another object of this invention is to provide a new key chain device.

A further object of this invention is to provide a combined key chain and game device.

A further object of this invention is to provide a new and improved entertainment device.

A further object of this invention is to provide a new and improved dice like key chain device.

A further object of this invention is to provide a new and improved board game.

A further object of this invention is to provide a combined key chain and game/toy device.

A further object of this invention is to provide a dice like device and game(s) therefore which may be played with a structured board type game or with a less formal structure such as on a table or other suitable surface.

BRIEF DESCRIPTION OF THE DRAWINGS

Other objects and advantages of this invention may be seen more clearly from the following description when viewed in conjunction with the accompanying drawings. Like numerals refer to like parts throughout.

DESCRIPTION OF THE INVENTION

Figure 1:
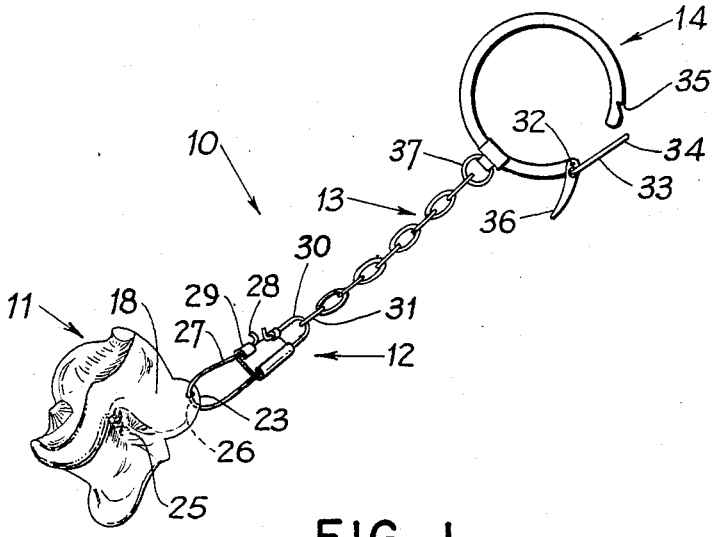
FIG. 1 is a prespective view of the dice like device and key chain in accordance with the invention.
Figure 2:
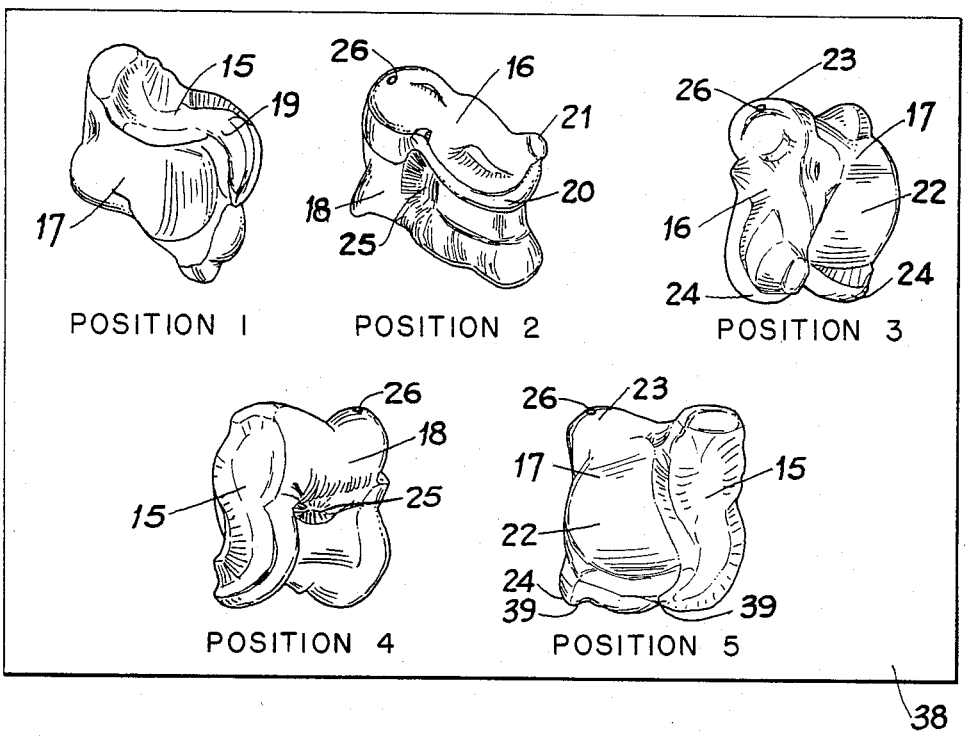
FIG. 2 is a prespective view of the dice like device detached from the key chain shown in FIG. 1 and illustrated in five different possible positions of rest on a playing surface.

Referring now to FIGS. 1 and 2, there is shown a dice and key chain retaining device 10 constructed in accordance with the invention to have a dice member 11, a dice retaining clip or clasp 12, a chain like member 13 and a key retaining ring 14.

The dice member 11 has a nonsymmetrical configuration with four distinctive sides or surfaces or faces 15,16,17 and 18. Each side 15,16,17 and 18, as will be discussed hereafter in more detail, is generally assigned or referred to by a symbolic name, for example, side 15 is called the king, having associative significance with the below game rules. Side 15 has somewhat of an "S" configuration with an "S" or serpentine shaped indentation 19. Side 16 has somewhat of an "8" configuration with one or more ridges 20 and projections 21. Side 17 has a somewhat pot bellied curvature 22 with generally projecting corner ridges or ears 23 and leg portions 24 which suggests or somewhat resembles a sack of flour. Side 18 has somewhat of a sack of flour configuration which has been punched or depressed in the center forming a concavity 25. Although the shape of the preferred embodiment of dice member 11 has been selected to generally resemble an ankle bone of a lamb or sheep, other configurations are possible in accordance with the spirit and function of the invention. Dice member 11 may be formed or molded from plastic, gold, silver or other suitable material to have a predetermined size and weight and positional stabilities as discussed below in detail.

A corner or ear 23 is provided with a clip receiving hole 26 to receive a portion of clasp 12 in detachable manner.

Clasp 12 may be of conventional design, for example, somewhat resembling a safety pin, to have a hook or bent portion 27 with an end 28 which is lockably received within a latch or locking head means 29. In the open position (not shown) end 28 may be fed or removed from hole 26 to detach dice member 11 from clasp 12. Clasp 12 may be formed from a metal spring wire and bent to have a generally oblong configuration and head means 29. The upper end 30 is attached, for example, by inserting through a link 31 of chain 13 or by welding thereto. An alternative embodiment (not shown) of clasp 12 may comprise a screw or bolt like member having its head portion attached to link 31 and having external or male threads for matingly engaging with internal or female threads provided about a bore hole within a portion of dice member 11.

Chain 13 may be formed of a plurality of interconnected metal links in conventional manner to have a predetermined length, for example, between two and six inches.

Key retaining ring 14 may be of conventional design having a generally circular configuration with a section being formed by a pivot 32 mounted clasp 33. Clasp 33 includes a ring or bent portion 34 which may be hooked and unhooked from notch 35 by means of a handle or lever arm 36. Key retaining ring 14 is affixed to an end link 37, for example, by being inserted within link 37 or welded thereto or by other conventional means.

With particular reference now to FIG. 2, the five positions of dice member 11 having associative significance in accordance with a feature and function of the present invention will now be discussed in detail. Dice member 11 is shown lying on a generally flat horizontal surface or playing table 38 in five different positions or dispositions, i.e., position 1 through position 5. Each dice member 11 position 1 through 5 represents a possible chance resting or lying disposition with dice member 11 being tossed onto surface 38, following being detached from clasp 12. It should be recognized that generally only one dice member 11 is used to play the intended games and that the five distinct illustrated positions shown in FIG. 2 is shown to facilitate understanding of the possible dispositions of dice member 11 with being tossed onto surface 38.

Position 1 illustrates dice member 11 resting on table 38 with its (king) side 15 facing upwardly and surface 16 facing downwardly, i.e., side 16 lying in contact with table 38. The dimensions and configuration of surface 16 relative to the overall shape of dice member 11 predisposes dice member 11 to have a first probability, for example, approximately a one-out-of-ten chance, of occurring whereby side 15 is rolled, i.e., faces upward with dice member 11 tossed onto table 38. Position 1 is also indicative of sides 17 and 18 as facing sidewardly in opposite directions.

Position 2 illustrates dice member 11 resting on table 38 with side 16, which is hereafter also called the tax collector or executioner or wine steward or bartender or king's messenger, facing upwardly and with side 15 facing downwardly on table 38. The dimensions and configuration of surface 15 relative to the overall shape of dice member 11 predisposes dice member 11 to have a second probability, for example, approximately a one-out-of-ten chance, of occurring whereby side 16 is rolled, i.e., faces upwardly with dice member 11 being tossed onto table 38. Position 2 is also indicative of sides 17 and 18 facing sidewardly in opposite directions.

Position 3 illustrates dice member 11 resting on table 38 with side 17, which is hereafter also called the baker, facing upwardly and with side 18 facing downwardly on table 38. The dimensions and configuration of surface 18 relative to the overall shape of dice member 11 predisposes dice member 11 to have a third probability, for example, approximately a one-out-of-two or a one-out-of-three chance, of occurring whereby side 17 is rolled, i.e., faces upwardly with dice member 11 being tossed onto table 38. Position 3 is also indicative of sides 15 and 16 facing sidewardly in opposite directions.

Position 4 illustrates dice member 11 resting on table 38 with side 18, which hereafter is also called or has symbolic association as the punishment or duty side/indicator, facing upwardly and with side 17 facing downwardly on table 38. The dimensions and configuration of surface 17 relative to the overall shape of dice member 11 predisposes dice member 11 to have a fourth probability, for example, approximately a one-out-of-two or a one-out-of-three chance, of occurring whereby side 18 is rolled, i.e., faces upwardly with dice member 11 being tossed in rolling manner as above onto table 38. Position 4 is also indicative of sides 15 and 16 facing sidewardly in opposite directions.

Position 5 illustrates dice member 11 resting on table 38 in a stand up or on end position supported on substantially flat or aligned surfaces or projections 39 of legs 24. This position is relatively rare and is denoted as Pegasus. The dimensions and configuration of projections or feet 39 relative to the overall shape of dice member 11 predisposes dice member 11 to have a fifth probability, for example, approximately a one-out-of-a-thousand chance, of dice member 11 assuming position 5 with being tossed onto table 38. Position 5 is also indicative of sides 15,16 and 17,18 facing sidewardly in opposite direction.

Figure 3:
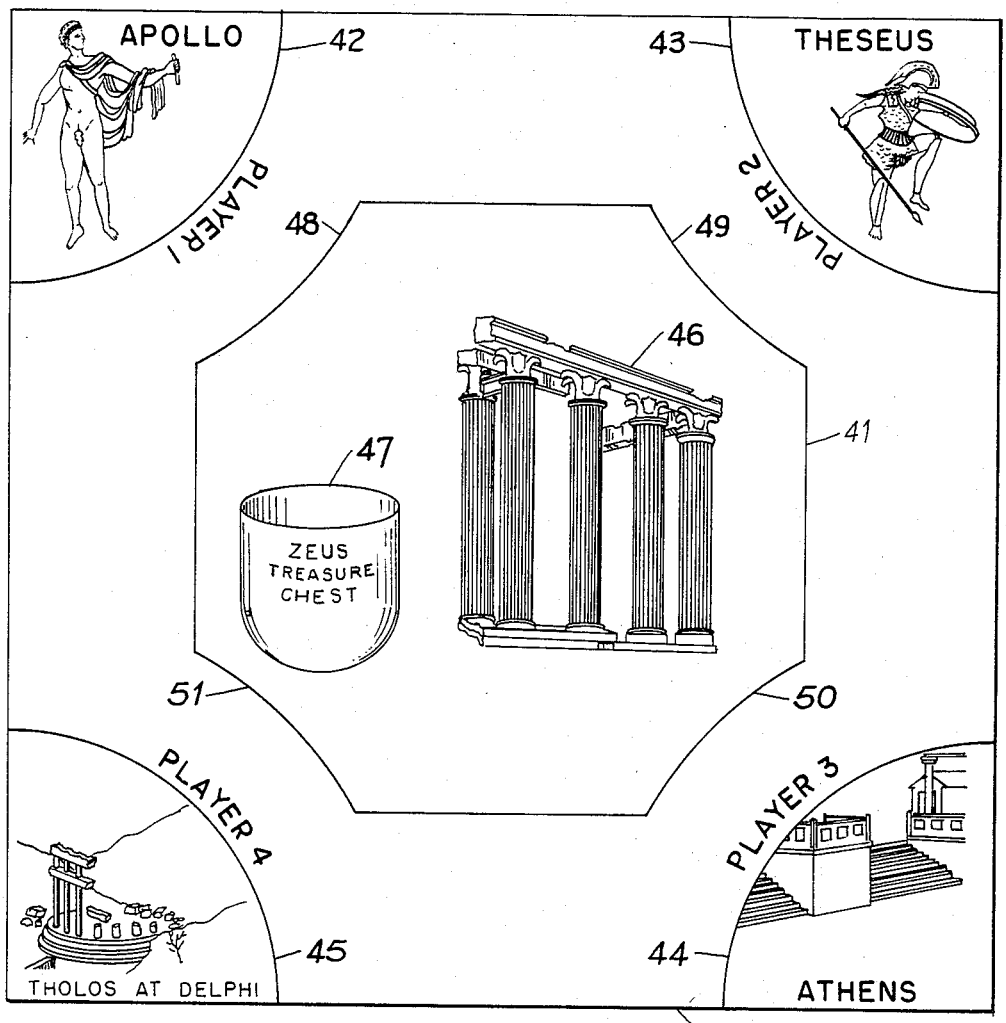
FIG. 3 is a top plan view of a preferred game board for use in combination with the dice like device shown in FIGS. 1 and 2 in accordance with the invention.

With reference now to FIG. 3, there is shown a preferred playing board or surface 40. Playing board 40 may comprise a sheet, for example, of paper or a plasticized coated paper, having a flat square shape with a length and width each being approximately twenty inches. The playing surface 40 has printed thereon a plurality of associative or symbolic pictures or indicia 41,42,43,44 and 45. Picture 41 contains, for example, a representation of the temple of Zeus 46 and a chest 47 symbolic of a pot of gold or jack pot or treasure chest of Zeus the god of the sky and ruler of the Olympian gods in Greek mythology. Picture 41 is bordered by a generally rectangular outline having concave corners 48,49,50 and 51. Each corner of playing board 40 contains the semi-encircled pictures 42–45 and a player designation or indicia player 1 through player 4, respectively. Each picture 42–45 contains a symbolic representation of, for example, the Apollo Belvedere, Theseus, a view of Athens and the Tholos at Delphi, respectively. The other side of the playing board (not shown) may contain a brief statement about Greek mythology and the instructions and rules for playing one or more games in accordance with one feature of the present invention.

Figure 4:
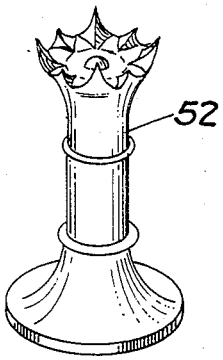
FIG. 4 is a side view of a symbolic king figure.
Figure 5:
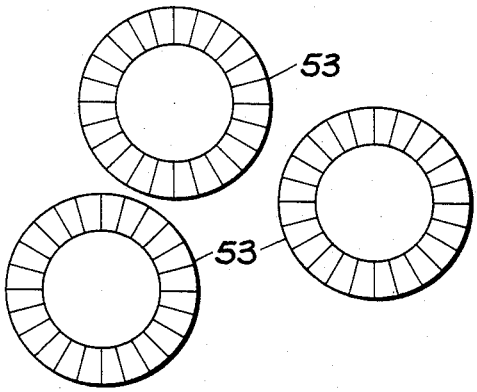
FIG. 5 is a top plan view of symbolic gold coins or playing chips.

With reference to FIG. 4, there is shown a symbolic king figurine 52 which may be provided with the playing board 40 or any conveniently available like figurine, for example, from a typical chess board game may be utilized.

In accordance with one or more games discussed hereafter, a plurality of playing chips 53 may be provided with playing board 40 or any conveniently available chips or coin like items may be used as a means of keeping score or to determine a game winner.

OPERATION AND GAME INSTRUCTIONS

In order to use dice member 11 in one or more of the below discussed games, clasp 12 is opened and dice member 11 is removed therefrom. Dice member 11 when being used in accordance with these games is called the oracle 11 to convey or impart a mystical quality thereto through which a supposed or imagined deity, for example, Zeus, provides answers or decisions or hidden knowledge by means of the rolled oracle 11 position 1 through position 5 (see FIG. 2). It being understood that such deity and magical powers are merely game assumptions and mythologized background and that no such powers are in fact to be attributed to oracle 11.

Game-one is called the "fortune teller" or "fortune telling" game which may be played by one or more persons. The oracle 11 is rolled or tossed onto a playing surface, for example, board 40, following the asking of a question such as, for example, will this be a good day for me or the like which query destiny or fate. If the king, i.e., side 15 position 1, is rolled by the inquisitor, it is deemed or pretended to mean that the fates are with him/her or that good luck will follow or he/she will be dominant and have general well being and the like. Thus the king 15 symbolizes a favorable answer to the inquiry. If the executioner, i.e., side 16 position 2, is rolled by the inquisitor, it signifies or warns the inquisitor that he/she may have a potential or proclivity that day, either intentionally or unintentionally, to cause harm or injury to others. Thus the inquisitor is alerted to be careful in his/her actions lest needless or unwanted wrongdoing may result. If the baker, i.e., side 17 position 3, is rolled by the inquisitor, it signifies that during the day the inquisitor can be hopeful of attaining material goods or wealth, will have plenty to eat and will generally find contentment and satisfaction. IF the inquisitor rolls side 18, i.e., position 4, he/she is warned that there is potential that day of encountering physical or mental injury or punishment, or may encounter some bad luck. If Pegasus, i.e., position 5, is rolled by the inquisitor it symbolizes that very unusual events and occurrences may take place that day. In this manner, oracle 11 may be used for self entertainment and/or to provide amusement to others.

Game-two is called the "Tax Collector" or "Olympian Casino" which may be played by two or more persons. Although the game may be played on any suitable surface using only the oracle 11, preferably board 40, king 52, and a plurality of chips 53 may be utilized.

Accordingly, with reference to FIGS. 2–5, the game-two rules and operation will generally be described. The game is played with a single oracle or dice member 11. Each of four players selects or is assigned a respective symbolic corner of board 40, for example, player one (not shown) is assigned to corner picture area 42 which is denoted as player 1, player two (not shown) is assigned to the player 2 or picture 43 region, player three (not shown) is assigned to the player 3 or picture 44 region and player four (not shown) is assigned to the player 4 or picture 45 region. Each player one through four is provided with a plurality of chips, for example, twenty chips each, and a similar quantity of chips, i.e., twenty, is placed on top of picture 41 to symbolize the treasury or house chips. Picture 41 as noted above may contain a representation of the temple of Zeus 46 and a jack pot or Zeus treasure chest 47 to mythologize the game. Pictures 42 through 45 may each be of a different depiction, for example, of Apollo, Theseus, the public square of Athens during the Golden Age of the city, and Tholos at Delphi, respectively, to somewhat mythologize the game/entertainment experience.

The object of the game is to acquire the most or all of the chips in the game with the jack pot or treasure chest 47 being emptied. If a player loses all of his/her chips he/she is out of the game.

This game is played by each of the players 1–4 taking a turn, for example, in clockwise order beginning with player 1, at rolling/tossing dice member 11 onto playing board 40 until all of the chips (not shown) in the center of the board 40, i.e., the treasury or house chips, are depleted or the players call for an end to the game. The player having the most chips at the end of the game is the winner.

Each of the five distinct positions, i.e., position 1 through position 5 (see FIG. 2), possibilities which may occur with each roll of dice member 11 is assigned a game point or chip reward or chip payment consequence. For example, if the king 15 (position 1) is tossed, the king figurine 52 is passed to or placed at the throne corner of the respective player who rolled the king 15 to symbolize that he/she is the then current king or ruler and shall remain so until a subsequent other player becomes the king or ruler by tossing dice member 11 to the king 15 disposition. If a player tosses dice member 11 to the tax collector 16 (position 2) orientation, this player is entitled to take or remove one of the house or treasury chips 53 at the center of playing board 40. If a player tosses dice member 11 to the baker 17 (position 3) orientation, this player gets an additional or free toss/roll of dice member 11. If three bakers 17 are tossed consecutively in a row by a player that player is entitled to take or receive one of the treasury chips 53 at the center of playing board 40 and thence passes dice member 11 to the next successive player. If a player tosses dice member 11 to punishment 18 (position 4) orientation, this player must donate or give the then current king or ruler player one chip. However, if no king or ruler has yet been anointed by dice member 11 as described above, a condition which may occur for a short period following the start of this game, the player who tossed the punishment 18 side of dice member 11 must pay one chip into the treasury at the center of playing board 40. If a player tosses dice member 11 to Pegasus, i.e., position 5 as shown in FIG. 2, that player is entitled to take or remove all the chips in the treasury at the center of the board 40 which, thereby, ends the game. The player with the most chips at the end of the game is designated the winner.

It should be recognized at this time that although the king 52 figurine was utilized above, use of a figurine is merely for convenience of the players to keep track of who is then current king and that use of a figurine may be eliminated and the players are obliged to mentally keep track of who is the current anointed king.

It should also be recognized that although a preferred embodiment of dice member 11 has been described to generally have the shape of a sheep's ankle bone and approximate position 1 through position 5 rolled probabilities were estimated therefore, that various other configurations of dice member 11 may be utilized to provide correspondingly varying probabilities of rolling/tossing one or more of the selected contoured sides. Thus, in accordance with the invention, a dice member may be designed or selected to have two or three or four or five distinctively different shaped sides and/or end portions such that two or more of these sides and/or end portions have a correspondingly different possibility of aligning or coming to rest on a substantially flat surface with being tossed thereon.

It is also noted that, in accordance with a further feature of the invention, that the dice member 11 may be coated with a paint or layer 54 of any suitable luminescent material, for example, a phosphorescent substance or other commercially available substance, which will emit light such that the dice member 11 will glow in the dark to enable the playing of one or more of the above games in a relatively poorly lit or dark area.

While there has been shown what is considered to be the preferred embodiments of the invention, it is desired to secure in the appended claims all modifications as fall within the true spirit and scope of the invention.

I claim:

1. A game device, comprising:

a dice means having a nonsymmetrical configuration including a first (15), a second (16), a third (17) and a fourth (18) sides, and having a first end portion defined by a pair of spaced substantially rounded ear projections (23) and a second end portion defined by a pair of spaced leg projections (24), said first side being S-shaped with an S-shaped trough (19), said second side being opposite to said first side and having a whip-shaped curved ridge (20) extending from a knob like projection (21), said third side being substantially rectangular shaped with a central outwardly curved portion (22), said fourth side being opposite to said third side and having a substantially rectangular shape with a central recessed portion (25), said dice means configured for being tossed or rolled onto a playing surface such that one of five different resting positions each having an assigned game significance being possible by said dice means with each toss or roll thereof; and a substantially flat rectangular playing surface board means having a plurality of mythography pictures each provided generally about a respective corner region of said board means and a central picture.

2. A game device as in claim 1, wherein:

the dice means is shaped substantially similar to an ankle bone of a sheep.

3. A game device as in claim 1, wherein:

the sides (15,16,17,18) and legs (24) of said dice means are each configured to enable said dice means to be placed in five distinct positions on a flat surface.

4. A game device as in claim 1, including:

a key chain means having a chain with a key ring affixed to one end and a clasp means for detachably clasping said dice means thereto.

5. A game device as in claim 1, wherein:

a first position of said dice means has a game meaning indicative of good luck and the like during that day;

a second position of said dice means has a game meaning indicative of a potential for causing harm and injury to others that day;

a third position of said dice means has a game meaning indicative of plenty of good food to eat, attainment of wealth and contentment that day;

a fourth position of said dice means has a game meaning indicative of a possibility of encountering physical or mental injury or punishment that day; and a fifth position of said dice means has a game meaning indicative that very unusual events may take place that day.

6. A game device as in claim 1, including:

a key chain means having a clasp for being detachably affixed to said dice means.

7. A method of entertaining or playing a game with one or more persons comprising the steps of:

providing a single dice member having a shape substantially similar to an ankle bone portion of a sheep; assigning a meaning or associative significance to one or more of a possible five distinctive positions of the dice member with being tossed or rolled onto a substantially flat playing surface by a player;

providing a plurality of playing chips to each player; providing a jack pot having a plurality of playing chips; effecting game rules and activity including (a) each player taking a turn at rolling/tossing the dice member onto a playing surface, (b) if a predetermined first position whereby a designated king side of the dice member is rolled/tossed by a player that player is thence anointed the current king, (c) if a predetermined second position whereby a designated tax collector side of the dice member is rolled/tossed by a player that player collects a chip from the jack pot, (d) if a predetermined third position whereby a designated baker side of the dice member is rolled/tossed by a player that player gets an additional toss/roll of the dice member and if this player tosses/rolls three consecutive baker sides that player collects a chip from the jack pot, (e) if a predetermined fourth position whereby a designated punishment side of the dice member is rolled/tossed by a player that player must pay one chip to the king or if no king has yet been anointed this player must put one chip into the jack pot, (e) if a predetermined fifth position designated as Pegasus of the dice member is rolled/tossed by a player that player collects all the chips in the jack pot thereby ending the game, (f) the player having the must chips at the end of the game is declared the winner.

8. A method of entertaining or playing a game as in claim 7, including:

providing a substantially square playing board having the playing surface formed thereon with a plurality of mythography representations depicted thereon; and providing a symbolic king figurine for being placed on the playing surface in front of the anointed king.

9. A method of entertaining or playing a game as in claim 7, including:

the dice member being coated with a luminescence material to enable the dice member to be perceptible or seen in a poorly lit or dark area to enable entertaining or playing a game with the luminescent dice member with poorly lit or dark environmental conditions.

* * * * *